United States Patent [19]

Walker, Jr.

[11] 4,189,197

[45] Feb. 19, 1980

[54] PORTABLE DESK

[76] Inventor: George O. Walker, Jr., 409 Hessel Blvd., Champaign, Ill. 61820

[21] Appl. No.: 934,208

[22] Filed: Aug. 16, 1978

[51] Int. Cl.[2] ..... A47B 43/00

[52] U.S. Cl. ..... 312/258; 312/281; 312/314; 108/78

[58] Field of Search ..... 312/258, 265, 310, 140.2, 312/314, 281, 282, 241, 225, 224; 108/111, 134, 152, 78

[56] References Cited

U.S. PATENT DOCUMENTS

| | | | |
|---|---|---|---|
| 1,524,767 | 2/1925 | Vandervoort | 312/281 |
| 1,700,545 | 1/1929 | Sanders | 312/310 |
| 1,953,655 | 4/1934 | Miller | 312/314 |
| 2,210,220 | 8/1940 | Soisson | 108/78 |
| 2,420,698 | 5/1947 | Best | 108/78 |
| 2,566,256 | 8/1951 | Snyder | 312/310 |
| 2,677,588 | 5/1954 | Couse | 312/258 |
| 2,731,317 | 1/1956 | Buncan | 108/78 |
| 3,285,206 | 11/1966 | Hoffman | 108/134 |
| 3,748,010 | 7/1973 | Garte | 312/314 |

*Primary Examiner*—Victor N. Sakran
*Attorney, Agent, or Firm*—David V. Munnis

[57] ABSTRACT

Portable desk having a main rectangular body including one or more compartment areas for storing items, having a foldable table portion which, on closure, covers the storage compartments, and having a plurality of extendable legs which are collapsible into the main body portion. One or more bar elements are adaptable initially for storage within the table element and, on fold-out of the desk, to be fitted within aligned slots in each the table porton and main body to support a table and supplementally to assist in bracing the extended leg members against lateral movement. Supplemental means also are provided to render the extended leg members to be respectively adjustable to various lengths to allow the desk to be leveled when unfolded and set up on an uneven surface or terrain.

6 Claims, 5 Drawing Figures

PORTABLE DESK

BACKGROUND OF THE INVENTION

This invention relates to a portable desk and more particularly to a portable desk having an interior storage compartment area and table and leg members which are foldable and/or collapsable to form a compact, easily portable unitary package.

In every field of endeavor involving the preparation and reference to printed materials a need exists for at least a temporary provision of a work surface upon which the paticular material being used can be placed. Under normal circumstances, such a work surface may be provided by a rigid desk or other permanent table. In many instances, however, available space limitations, as in the case of crowded apartments and other small living accomodations, or general location circumstances, such as in the case of land surveyors, field engineers, building construction personnel, traveling salesmen and other persons whose activities require them to be mobile and yet functioning in locations and terrains of widely differing loci and characteristics, substantially eliminate the feasibility of utilizing conventional permanently rigid work surfaces.

To attempt to overcome such difficulties it has been suggested in the art to utilize temporary work surfaces, including collapsible tables and desks. The designs of such previously proposed collapsible temporary work surfaces, however, have usually suffered from one or more drawbacks in either failing to provide a work surface table area of adequate size and/or heighth, being suitable for use only on level ground, or being devoid of any or adequate internal storage space.

Accordingly, a search has continued in the art for an improved portable desk having overall advantageous and versatile characteristics.

OBJECTS OF THE PRESENT INVENTION

Accordingly, it is the primary object of the present invention to provide a novel portable desk having advantageous and versatile characteristics.

It is another object of the present invention to provide a portable desk which is collapsible into a compact, easily carriable unitary package and which can be unfolded to provide a unit having two separate work surfaces, i.e., one surface upon which reference materials can be placed and a second table surface upon which writing activities can be performed.

Another object of the present invention is to provide an improved portable desk having a writing surface which is a suitable heighth, e.g., thirty inches, above the ground or floor surface upon which the uncollapsed and unfolded desk is placed for use.

A further object of the present invention is to provide a novel portable desk having adequate and desirable work surface area and in addition advantageous internal storage compartment areas.

Yet an additional object of the present invention is to provide a novel portable desk having advantageous work surface and storage areas and yet which is simple in construction and economic in design.

A particular object of the present invention is to provide a relatively inexpensive portable desk having advantageous work and storage areas yet which is not only sturdy in construction when in an uncollapsed state but versitile in use in advantageously being adapted to provide level work surfaces in flat or uneven terrains.

These and other objects are satisfied and accomplished by the characteristics of the novel portable desk of the present invention which, broadly described, comprises:

(1) A main rectangular body having at least one opening in the forward face thereof for storing items, (2) A table hingeably attached to the forward face of said main body and adapted to be folded (a) upwardly against said forward face of said main body to cover said storage opening therein, and (b) downwardly to form thereby a horizontal work surface, (3) Means for supporting said table in said work surface-forming position comprising at least one slot formed in the bottom of said table and at least one slot formed in the bottom of said main body, said table slot and said main body slot being in alignment with each other when said table is in said work surface-forming position, and a bar element, said bar element being adapted (a) for slidable movement along the axis of said slots, (b) to be retained within said slots against movement radial to the axis of said slots, (c) to be fitted completely within said table slot wherein said table is in said upward folded position and, (d) when said table is in said work surface-forming position, to be fitted partially within each of said aligned table and main body slots to thereby support said table against vertical movement, and (4) A plurality of leg means, rectractable within and extendable from said main body, for supporting said main body, when in said extended position, at least one of said main body support leg means, when in said extended position, being engageable with said bar element whereby said bar element assists to retain said main body support leg means against lateral movement.

DESCRIPTION OF SPECIFIC EMBODIMENT OF THE PRESENT INVENTION

Having been broadly described, the present invention will be more readily understood from the following description of specific embodiments thereof given with reference to the attached drawing of which:

Figure 4:
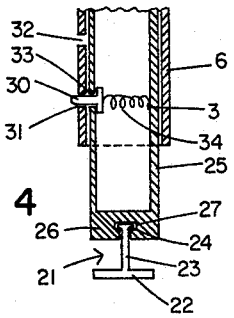
Figure 5:
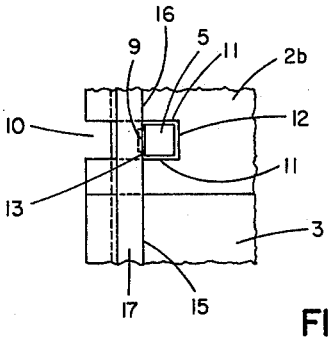

FIG. 4 is a side view partially in section showing an embodiment of the length adjustment feature and mechanism of the portable desk of the present invention. And FIG. 5 is a bottom view, partially broken away and partially in section, of the unfolded embodiment of the portable desk of the present invention shown in FIG. 1 showing the cooperation between the table element-supporting and leg-locking means of the desk.

Figure 1:
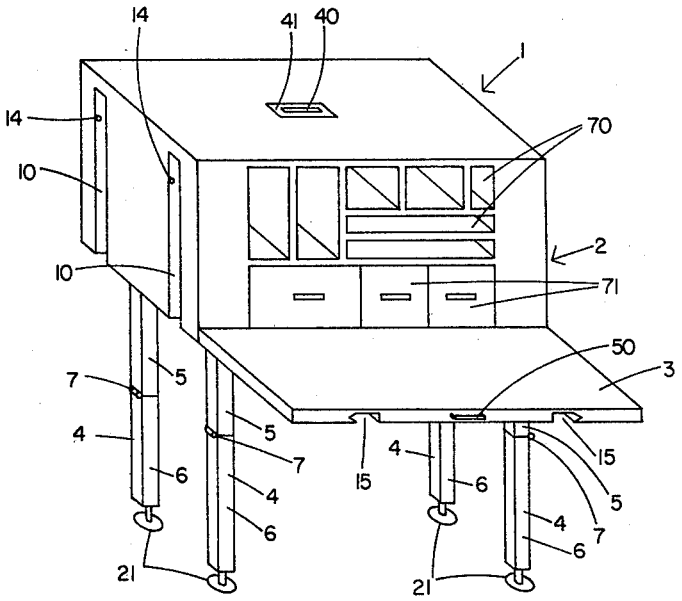
FIG. 1 is a perspective view of an embodiment of the portable desk of the present invention showing the desk in uncollapsed and unfolded condition ready for use.
Figure 2:
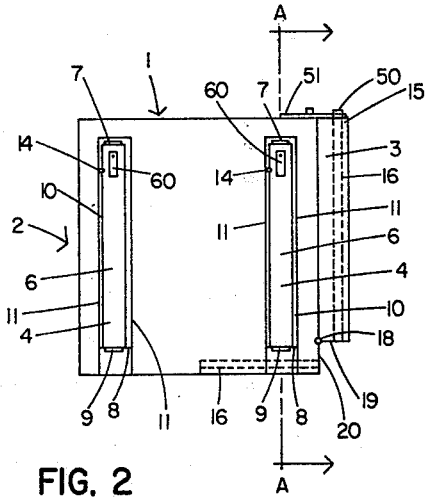
FIG. 2 is a partial side view of the portable desk of the present invention showing the desk in a collapsed condition.

With reference to FIG. 1 numeral 1 generally designates the portable desk assembly of the present invention, which table comprises a rectangular main body 2, generally closed on its sides, in which are located a plurality of item storage components, e.g., compartments 70 and drawers 71, each of which open toward the forward face 20 of main body 2. A table element 3 is hingedly attached to main body 2 by hinge means 18, with table 3 being adapted, when folded upwardly, as shown in FIG. 2, to abut and contact the forward face 20 of main body 2 and cover the openings of compartments 70 and drawers 71, and, when folded downwardly, as shown in FIG. 1, to form thereby a lower horizontal work surface. The latter, in combination with the top surface of main body 2, provides the desk of the present invention with two separate work surfaces. This feature allows one using the portable desk of the present invention to utilize the top of main body 2 as a support surface for reference materials, e.g., books, plans, maps, sales samples, etc., and to employ the table 3 as a work surface on which to write.

Figure 3:
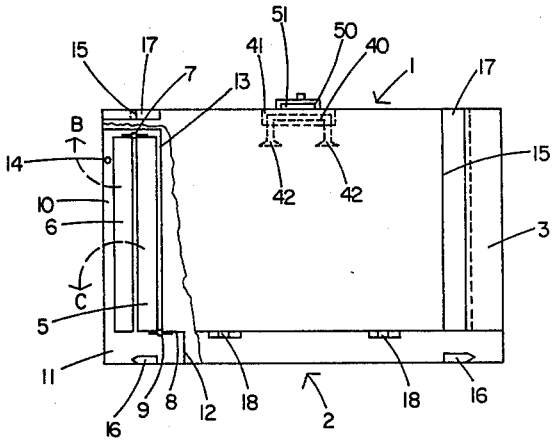
FIG. 3 is a front view, partially broken away, of the portable desk of the present invention in a collapsed condition.

Table 3, in its folded-down position, is partially given vertical support by an abutment of its rear surface 19 with main body forward face 20. Further means for supporting table 3 in this position is provided by table 3 and main body 2 having slots 15 and 16, respectively, formed in the bottoms thereof, with the slots in each of slot pairs 15–16 being in direct alignment with each other when table 3 is in the folded-down position. In accordance with the present invention at least one of such slot pairs is provided, and preferably there are at least two pairs. Positioned within each slot pair 15–16 is a rod member 17 which is so shaped and of such a length that rod 17 is retained in place by frictional engagement normally, is adapted for slideable movement within and along the axis of slot pair 15–16, is retained within slot pair 15–16 against movement radial to the axis thereof, can be fitted completely and firmly within slot 15 when table 3 is in the folded-up position, as shown in FIGS. 2 and 3, and can be slid to be located partially within each of the slots of slot pair 15–16, as shown in FIG. 5, to thereby give vertical support to table 3 in the down position. This feature allows adequate support for table 3, in the desk of the present invention, without the need for auxiliary legs being located on table 3, contributing to design simplicity and economy.

Desk 1 according to the present invention includes a plurality of support leg means 4 which can be extended from main body 2, as shown in FIG. 1, to support the assembly, and are retractable within well openings or recesses 10 located within body 2, as shown in FIGS. 2 and 3. Preferably four support leg means 4 are provided, as shown, although three also suitably can be employed and are contemplated Leg means 4 suitably may be of rectangular or circular cross-section and may be of solid or hollowed, e.g., tubular, construction.

According to the present invention each leg means 4 includes an upper section 5 and a lower section 6, each of which is adapted to retracted within body 2 by suitable means, such as folding and/or telescoping and/or combinations thereof, such as wherein lower section 6 telescopes within upper leg section 5 and section 5 then folds within body 2. This feature advantageously allows the desk of the present invention to provide, when completely unfolded and opened, a table having an upper work surface which is at a height above ground level comparable to that, about 30 inches, of conventional permanent tables and desks, and yet allows the overall height of the collapsed desk unit to be maintained within suitably portable and unbulky limits, e.g. about 16–18 inches by making leg sections 5 and 6 of approximately or the same length.

Leg sections 5 and 6 of leg means 4, in the embodiment shown in FIGS. 2 and 3 may be hingeably attached together by hinge means 7, and leg means 4 may be hingeably attached to main body 2 by hinge means 9 to allow a leg means 4 to be removed from its storage well 10 in body 2 by rotating leg section 5 about hinge 8 in the direction of arrow C (FIG. 3) and rotating leg section 6 about 7 in direction B. Means, such as resilient rubber tab 14, is provided for releaseably holding a leg means 4 within its storage well 10 until it is desired to extend the desk legs. Auxiliary means, such as a strap 60, may be provided, where desired, to assist initially urging leg means 4 from its well 10.

Storage wells 10, as shown, for leg means 4 are formed by an opening in the surface, eg., the side, of main body 2, which opening has side walls 11, an upper back wall 13, and a lower back wall 12 further recessed within body 2 than wall 13 to accomodate leg means 4 when the latter is in a lower position by rotation about hinge 9. As shown in FIG. 5, with leg means in an extended vertical position normal to bottom surface 2*b* of main body 2, upper leg section 5 is located within a recess formed by sidewalls 11 and lower back wall 12 of well 10. With leg means 4 in such position, rod member 17, after table 3 is lowered to align slot pair 15–16, then may be slid into slot 16 rearwardly of well 10 to engage upper leg section 5 and thereby "lock" lowered leg means 4 in place against any lateral movement within its resultant enclosure.

In accordance with the invention at least one of leg means 4 is, and preferably at least two thereof are, "locked" in place by cooperation with table support rods 17. As shown, slot 16 in body 2 for rod 17 terminates intermediate forward and rear leg means 4 on the same side of body 2. It is contemplated that slot 16 may extend accross both wells 10 on the same side of body 2, particularly in instances wherein the depth of body 2 rearward of face 20 is narrow compared to the depth of table 3. Thus, all leg means 4 could be locked in place by rods 17, including in some cases by rods 17 which provide little or no support to table 3 due to the distance of their advancement into slot 16. In such latter instances, it may be desireable to provide a supplemental set of 15–16 slots, such as in the middle of table 3, which function in combination with a rod 17 therein solely to support supplementally table 3 without locking any leg means.

In preferred embodiments of the present invention, some, eg., the front two of four-legged embodiments and one of a three-legged embodiment, and more preferably all, of leg means 4 are provided with means adapting them to be respectively shortened and/or lengthened to thereby adjust the height and/or level of the table 3. In a preferred embodiment thereof, as shown in FIG. 4, such over-all length variation feature is provided by lower leg section 6 having an extension member 25 fitted in telescoping relationship therewith. Positioned within extension member 25 is a rigid plug element 30 which is biased to extend horizontally, through hole 30 in the wall of member 25, by a spring or biasing means 34 anchored to member at 35. Leg section 6 is provided with a series of vertically spaced holes 31, 32, etc. in its wall and which, with plug 30 being depressed, by an appropriate up or down movement of extension member 25 relative to section 6, can be aligned with hole 33 to provide, on release of plug 30, a locking of member 25 in the desired selected position to impart the desired length to leg means 4.

As shown, extension member 25 preferably is also provided at its lower end 26 with a socket 27 in which is positioned a leg foot element 21 having a horizontal base 22 connected by a vertical stem to a ball element 24 rotatably fitted within socket 27.

The above features of the leg means advantageously adapts the portable desk of the present invention to be utilized to provide a desireable level work surface on terrains and surfaces of widely varying characteristics.

Supplemental means for carrying the collapsed unit of the present invention suitably may be provided, such as a handle means 40, which as shown (FIGS. 1 and 3) preferably is recessed in the top to main body in a well 41 when not in use to maintain the usefulness of the top of main body 2 as a supplemental work surface. Means for releaseably closing table 3, such as a slideable latch comprising male element 51 and cooperating female element 50 also are provided.

I claim:

1. A portable desk comprising:

(1) A main rectangular body having at least one opening in the forward face thereof for storing items, (2) A table hingeably attached to the forward face of said main body and adapted to be folded (a) upwardly against said forward face of said main body to cover said storage opening therein, and (b) downwardly to form thereby a horizontal work surface, (3) Means for supporting said table in said work surface-forming position comprising at least one slot formed in the bottom of said table and at least one slot formed in the bottom of said main body, said table slot and said main body slot being in alignment with each other when said table is in said work surface-forming position, and a bar element, said bar element being adapted (a) for slidable movement along the axis of said slots, (b) to be retained within said slots against movement radial to the axis of said slots, (c) to be fitted completely within said table slot wherein said table is in said upward folded position and, (d) when said table is in said work surface-forming position, to be fitted partially within each of said aligned table and main body slots to thereby support said table against vertical movement, and (4) A plurality of leg means, retractable within and extendable from said main body, for supporting said main body, when in said extended position, at least one of said main body support leg means, when in said extended position, being engagable with said bar element whereby said bar element assists to retain said main body support leg means against lateral movement.

2. The portable desk according to claim 1 wherein said main body support leg means are adapted to be respectively shortened and lengthened to thereby level said table when said table is in said work surface-forming position.

3. The portable desk according to claim 1 wherein said table, when in said work surface-forming position, abuts said forward face of said main body to thereby assist in vertically supporting said downwardly folded table.

4. The portable desk according to claim 1 wherein a pluraliy of said aligned table slot-main body slot-bar element combinations are provided.

5. The portable desk according to claim 4 wherein said main body support leg means are adpated to be respectively shortened and lengthened to thereby level said table when said table is in said work surface-forming position.

6. The portable desk according to claim 4 wherein said table, when in said work surface-forming position, abuts said forward face of said main body to thereby assist in vertically supporting said downwardly folded table.

* * * * *